US005467712A

United States Patent [19]

Chou

[11] Patent Number: 5,467,712

[45] Date of Patent: Nov. 21, 1995

[54] PRINTING MACHINE WITH A PRINTING UNIT ADAPTED TO RECEIVE VARIOUS PLATE CYLINDERS

[76] Inventor: Ching-Ho Chou, No. 168, Pao-Chung-Erh St., Hou-Hu Li, Chia-Yi City, Taiwan

[21] Appl. No.: 324,028

[22] Filed: Oct. 14, 1994

[51] Int. Cl.[6] ..... B41F 5/04

[52] U.S. Cl. ..... 101/219; 101/349; 101/479

[58] Field of Search ..... 101/477, 479, 101/375, 212, 213, 216, 219, 223, 348, 349, 350

[56] References Cited

U.S. PATENT DOCUMENTS

| | | | |
|---|---|---|---|
| 3,470,816 | 10/1969 | Piecha et al. | 101/216 |
| 3,598,050 | 8/1971 | Thompson | 101/216 |
| 3,986,454 | 10/1976 | Granger | 101/216 |
| 4,545,518 | 10/1985 | Bergland | 101/223 |

FOREIGN PATENT DOCUMENTS

| | | | |
|---|---|---|---|
| 2055151 | 2/1981 | United Kingdom | 101/219 |
| 1595457 | 8/1981 | United Kingdom | 101/219 |

*Primary Examiner*—Eugene H. Eickholt
*Attorney, Agent, or Firm*—Christie, Parker & Hale

[57] ABSTRACT

A printing unit of a printing machine includes a pair of spaced and opposed walls which are provided with a pair of mounting holes, and an impression cylinder journalled between the opposed walls below the mounting holes. The opposed walls have a pair of aligned mounting seats mounted respectively and detachably in the mounting holes. The mounting seats are formed with a pair of aligned bushing-receiving holes therethrough corresponding with a certain size of a plate cylinder to be journalled therein so as to perform a printing action in cooperation with the impression plate. An adjustable inking apparatus is mounted above the plate cylinder and corresponds to a position of the plate cylinder so that printing ink can be supplied to the plate cylinder.

2 Claims, 6 Drawing Sheets

PRINTING MACHINE WITH A PRINTING UNIT ADAPTED TO RECEIVE VARIOUS PLATE CYLINDERS

BACKGROUND OF THE INVENTION

1. Field of the Invention

This invention relates to a printing machine, more particularly to a printing machine with a printing unit which is adapted to receive various plate cylinders.

2. Description of the Related Art

Referring to FIGS. 1 and 2, a conventional printing machine is shown to comprise a base body 11, paper pulling mechanisms 131,132 mounted at two opposed end portions of the base body 11, and a plurality of printing units 2 mounted on the base body 11 for printing a continuous paper 12 which is pulled by the mechanism 131.

Each of the printing units 2 has a pair of spaced and opposed walls 20 provided on two sides of a paper-supplying route which passes through the printing unit 2, and a plate cylinder 21 and an impression cylinder 23 which are journalled respectively between the opposed walls 20 in a parallel manner for performing a printing action. A printing plate 22 is attached to the plate cylinder 21. An inking apparatus 24 for supplying printing ink to the printing plate 22 is mounted above the plate cylinder 21 and is associated with the same.

Note that in order to make the best use of a continuous sheet of printing paper, the printing plate 22 must possess a transverse length which is equal to the circumference of the plate cylinder 21. In the event that the transverse length of the printing plate 22 is shorter than the circumference of the plate cylinder 21, a blank space is formed between adjacent printed portions of the continuous paper, thereby resulting in waste of the printing paper. To overcome this drawback, the continuous paper 12 is arranged to be pulled by the mechanism 131 so as to pass between the plate cylinder 21 and the impression cylinder 23 and in order to receive a full print from the printing plate 22 and is then retracted rearwardly from the traveling route thereof by another mechanism 132 to permit printing at the blank space thereof. Thus, the continuous paper 12 is printed with minimum waste. However, such type of forward-and-retract paper supplying system slows down the printing speed of the printing machine. Therefore, the transverse length of the printing plate 22 must be equivalent to the diameter of the plate cylinder 21 to ensure that the printing machine performs at a continuous pace with minimum waste. However, since the transverse length of the printing plate 22 varies according to the printing requirements, the diameter of the plate cylinder 21 must also be varied to ensure that the printing machine is able to make the most effective use of the continuous sheet 12 of paper. It is noted that, in the conventional printing machine, the mounting positions for the plate cylinder 21, the impression cylinder 23 and the inking apparatus 24 are formed on the opposed walls 20 at fixed positions. Thus, if the plate cylinder 21 is replaced by one with a different diameter, the replaced plate cylinder is unable to correspond with the inking apparatus 24 and the impression cylinder 23.

Accordingly, the positions of any two among the plate cylinder 21, the impression cylinder 23 and the inking apparatus 24 should be changeable to correspond with the replaced plate cylinder.

SUMMARY OF THE INVENTION

Therefore, the main objective of the present invention is to provide a printing machine with a printing unit which has means to accommodate different sizes of plate cylinders and an adjustable inking apparatus which is capable of corresponding with the size of the plate cylinder that is installed.

Another objective of the present invention is to provide a printing machine which can print continuously a continuous sheet of paper with minimum waste.

According to the present invention, the printing machine includes at least one printing unit which is mounted on a base body for printing a continuous sheet of paper that is pulled through the printing unit by a paper supplying mechanism. The printing unit has a pair of spaced and opposed walls which are provided on two sides of and which are parallel to a paper-supplying route that passes through the printing unit, the opposed walls being formed with a pair of aligned mounting holes, and an impression cylinder which is journalled between the opposed walls below the mounting holes thereof. The opposed walls are further provided with a pair of mounting seats mounted respectively and detachably in the mounting holes and formed with two internal copper sleeves which define a pair of aligned bushing-receiving holes therethrough. The bushing-receiving holes correspond with a certain size of a plate cylinder to be journalled therein so as to perform a printing action in cooperation with the impression cylinder. The printing unit also has an inking apparatus with an adjusting mechanism to adjust the inking apparatus to complement a position of the plate cylinder so as to enable the inking apparatus to associate with the plate cylinder in order to supply printing ink to the plate cylinder.

In the disclosed embodiment, the inking apparatus includes a first transmission roller journalled between the opposed walls and located above the plate cylinder in a parallel manner, and a second transmission roller mounted between the plate cylinder and the first transmission roller. The adjusting mechanism includes at least one regulator mounted on an inner surface of the opposed walls, and a pair of pivot blocks provided between the spaced opposed walls. Each of the pivot blocks has a first end portion sleeved respectively and pivotally on two sides of an axle of the first transmission roller, and a second end portion located adjacent to the plate cylinder. The second transmission roller is journalled between the second end portions of the pivot blocks. The regulator is connected pivotally to the second end portion of a corresponding one of the pivot blocks. Actuation of the regulator pivots the corresponding one of the pivot blocks relative to the axle of the first transmission roller and enables the second transmission roller to be operable with the plate cylinder.

Note that the pair of mounting seats for journalling the plate cylinder can be detached from the opposed walls with ease and can be replaced with a new pair of mounting seats which are formed with bushing-receiving holes for journalling a new plate cylinder such that the latter contacts operably the impression cylinder. The inking apparatus can be adjusted easily to correspond with the replaced plate cylinder. Thus, the printing unit of this invention is able to perform a continuous printing action with minimum waste.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
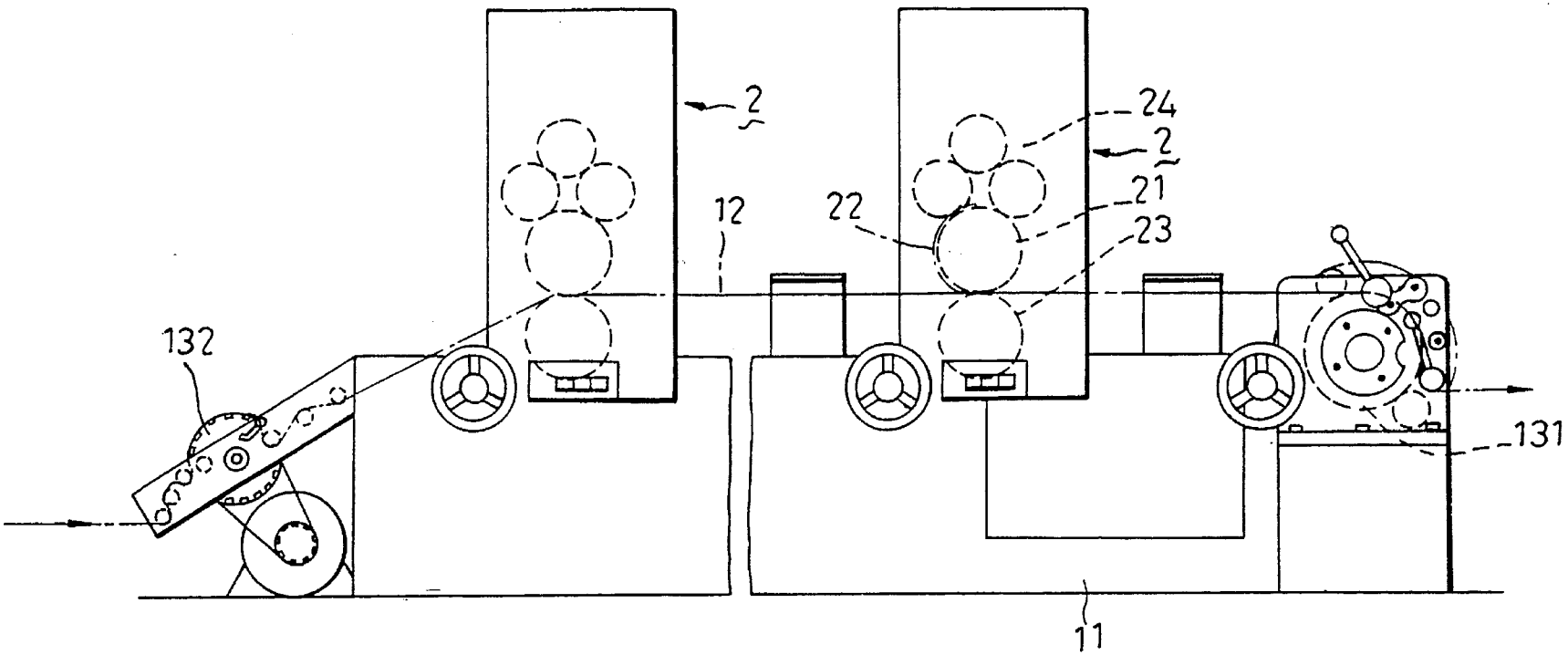
FIG. 1 (PRIOR ART)
FIG. 1 shows a side view of a conventional printing machine.
Figure 2:
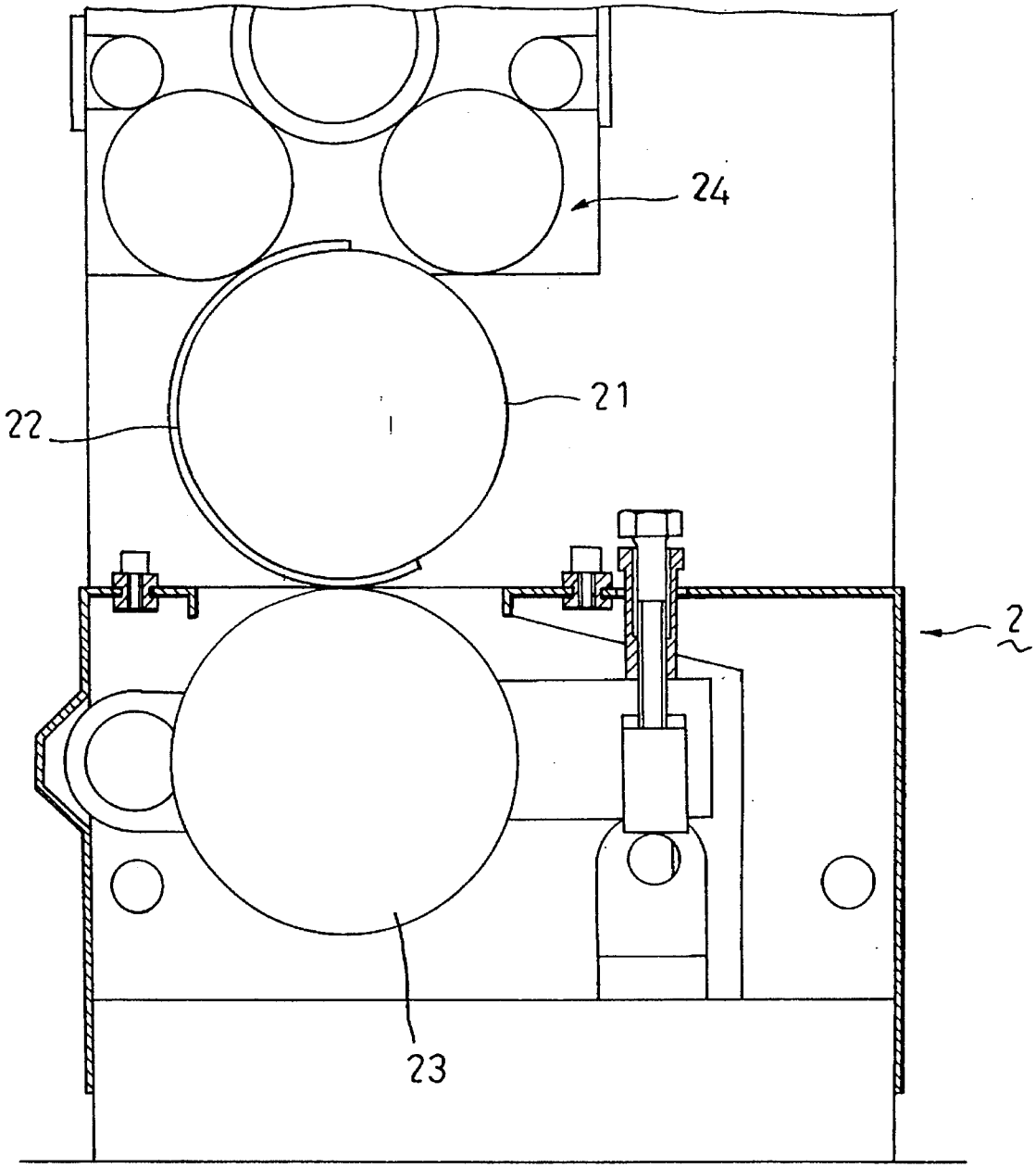
FIG. 2 (PRIOR ART)
FIG. 2 illustrates an enlarged view of a printing unit employed in the printing machine of FIG. 1.
Figure 3:
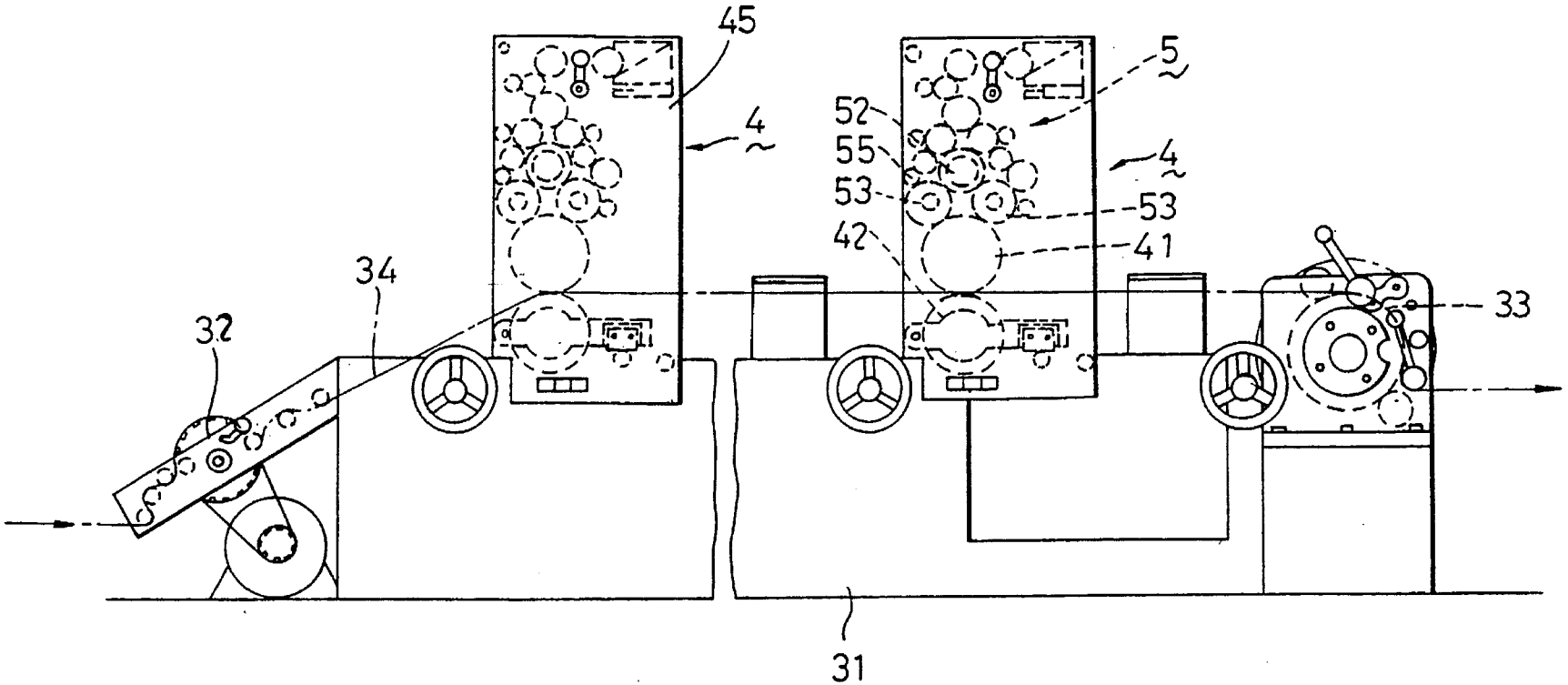
FIG. 3 is a side view of a printing machine according to the present invention.
Figure 5:
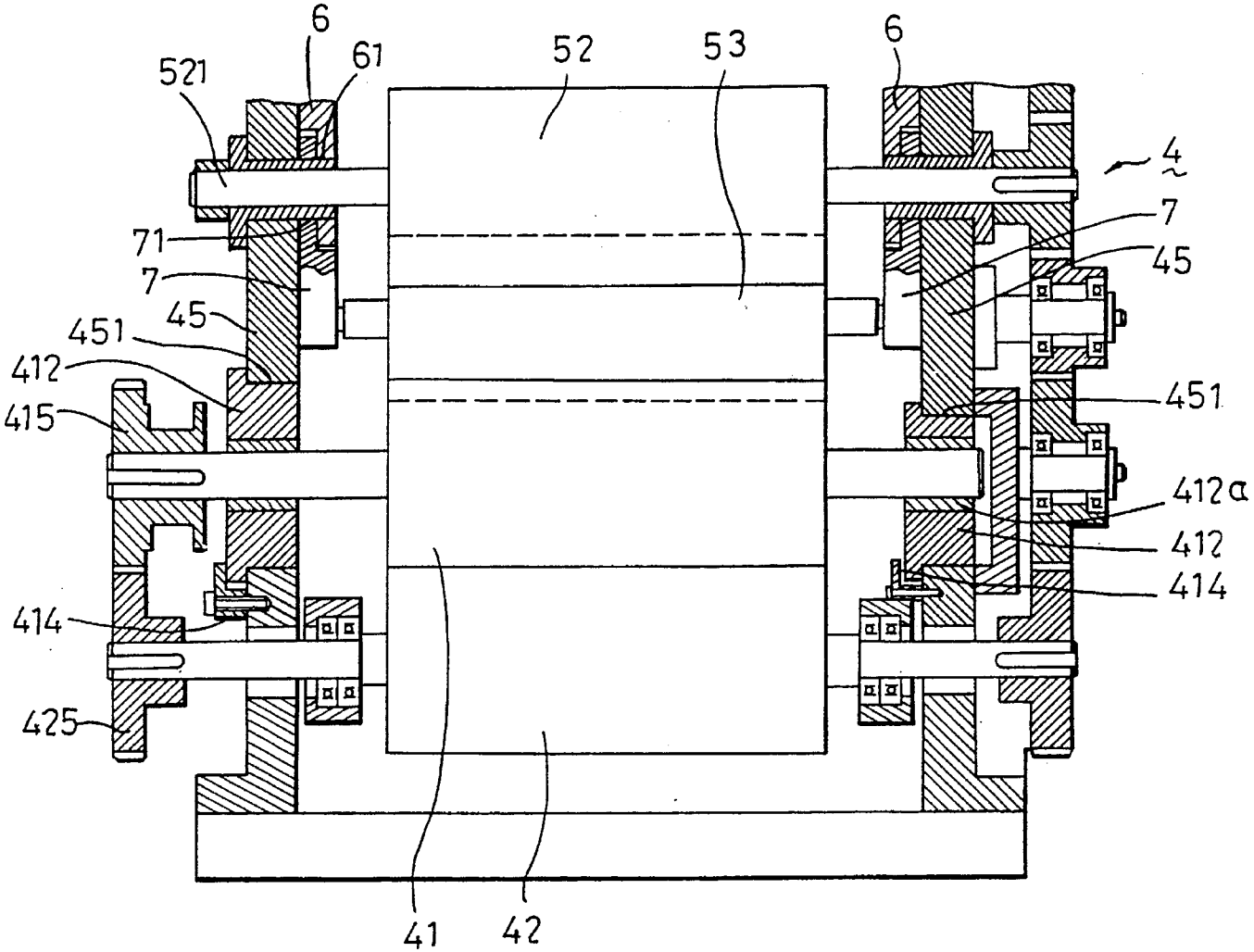
FIG. 5 shows a cross sectional view of the printing machine of FIG. 4 taken along the line V—V.

Referring to FIG. 3, a preferred embodiment of a printing machine according to the present invention is shown to comprise a base body 31, two printing units 4 mounted on the base body 31, a first paper pulling mechanism 32 at one end of the base body 31, and a second paper pulling mechanism 33 at another end of the base body 31. A roll of continuous paper 34 is mounted at the paper supplying mechanism 32. The paper 34 is fed through the printing units 4 and is pulled by the mechanism 33. Referring to FIGS. 3 and 5, each of the printing units 4 has a pair of spaced and opposed walls 45 provided on two sides of and parallel to a paper-supplying route which passes through the printing unit 4. The opposed walls 45 are formed with a pair of aligned mounting holes 451 therethrough. An impression cylinder 42 is journalled between the opposed walls 45 below the mounting holes 451. The opposed walls 45 receive detachably a pair of mounting seats 412 which are provided with two internal copper sleeves which correspondingly define a pair of aligned bushing-receiving holes 412*a*. A plate cylinder 41 with a certain size is journalled in the bushing-receiving holes 412*a* by the use of bushing assemblies. A pair of stoppers 414 are screwed to the opposed walls 45 to prevent the mounting seats 412 from disengaging the walls 45. In order for the plate cylinder 41 to rotate synchronously with the impression cylinder 42, two gear wheels 415, 425 are mounted respectively at distal ends of the axles of the cylinders 41, 42 under a meshed condition. Thus, the plate cylinder 41 can perform a printing action in cooperation with the impression plate 42.

Figure 4:
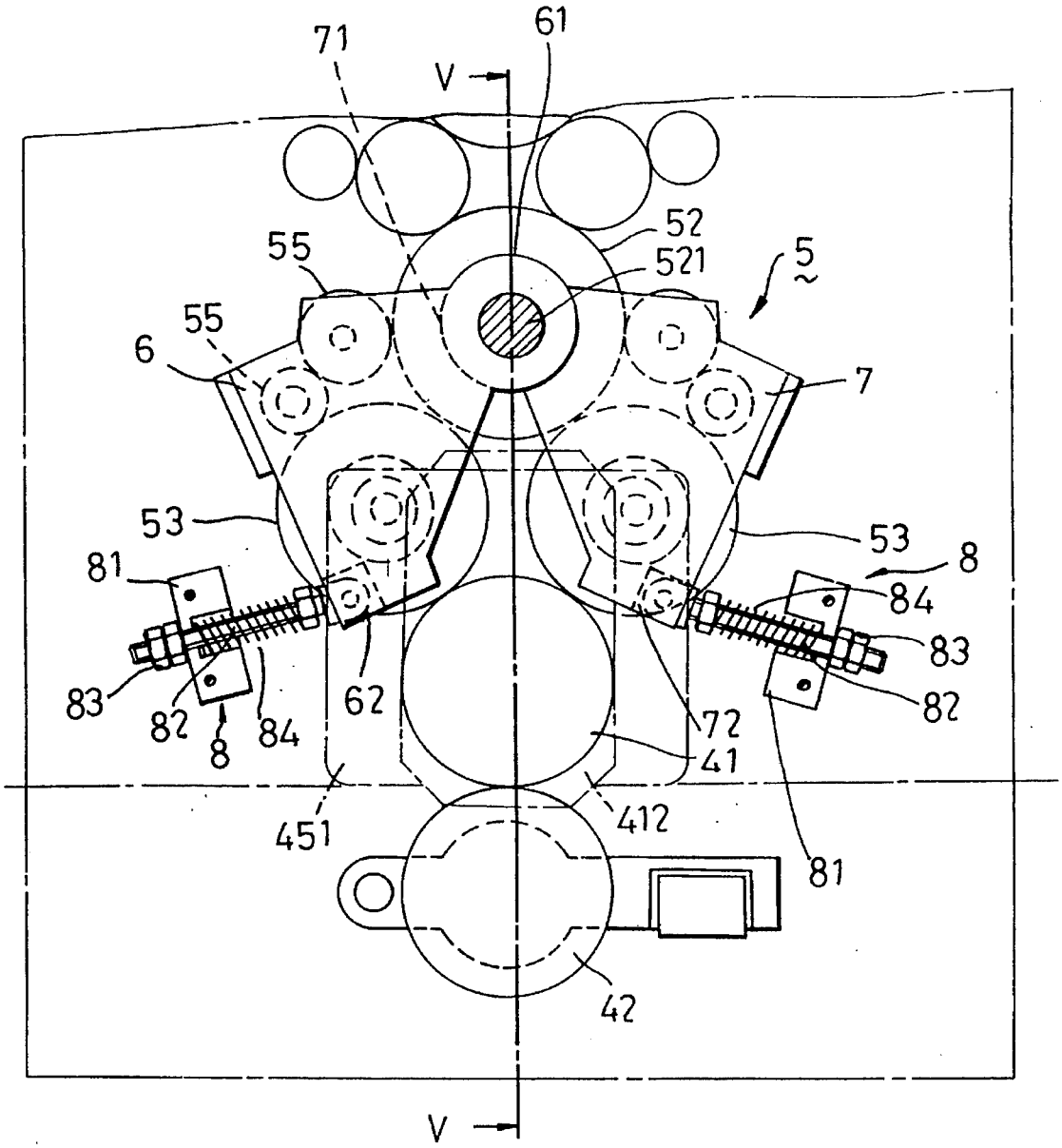
FIG. 4 illustrates the relationship among a plate cylinder, an impression cylinder and an inking apparatus of the printing machine of the present invention.

Referring to FIGS. 4 and 5, the inking apparatus 5 employed in this preferred embodiment is provided with an adjusting mechanism. The inking apparatus 5 includes a first transmission roller 52 journalled between the opposed walls 45 and located above the plate cylinder 41, two second transmission rollers 53, and two pairs of third transmission rollers 55, the connecting relationship of which will be described in the succeeding paragraphs. The adjusting mechanism includes a pair of regulators 8 mounted spacedly on an inner surface of the opposed walls 45 adjacent to the plate cylinder 41, and two sets of pivot blocks 6,7 provided between the opposed walls 45. Each set of the pivot blocks 6, 7 is constituted by two opposed members having a first end portion 61, 71 sleeved pivotally on a respective one of two sides of an axle 521 of the first transmission roller 52 and a second end portion 62, 72 connected to a respective one of the regulators 8. Note that each of the second transmission rollers 53 is journalled between the corresponding two of the second end portions 62, 72 of the pivot blocks 6, 7, while each pair of the third transmission rollers 55 are journalled by the opposed pair of pivot blocks 6,7. Under such a condition, the transmission rollers 52, 53, 55 between the opposed pair of pivot blocks 6, 7 are associated with one another such that regulation of the regulator 8 pivots a respective pair of the pivot blocks 6, 7 relative to the axle 521 of the first transmission roller 52. Thus, the second roller 53 contacts operably with the plate cylinder 41 so as to supply printing ink to a printing plate (not shown) mounted on the plate cylinder 41.

The regulator 8 is constituted by a positioning seat 81, an elongated rod 82, a compression spring 84 and nuts 83. The positioning seat 81 is fixed on an inner surface of the opposed wall 45 and has a through-hole formed therethrough. The rod 82 is inserted through the positioning seat 81 and has a first end pivoted to the second end portion 62, 72 of a corresponding pivot block 6, 7 and a second end threaded by one of the nuts 83. The compression spring 84 is sleeved around the rod 82 to bias the positioning seat 81 so as to retain the second transmission roller 53 at a desired position.

Figure 6:
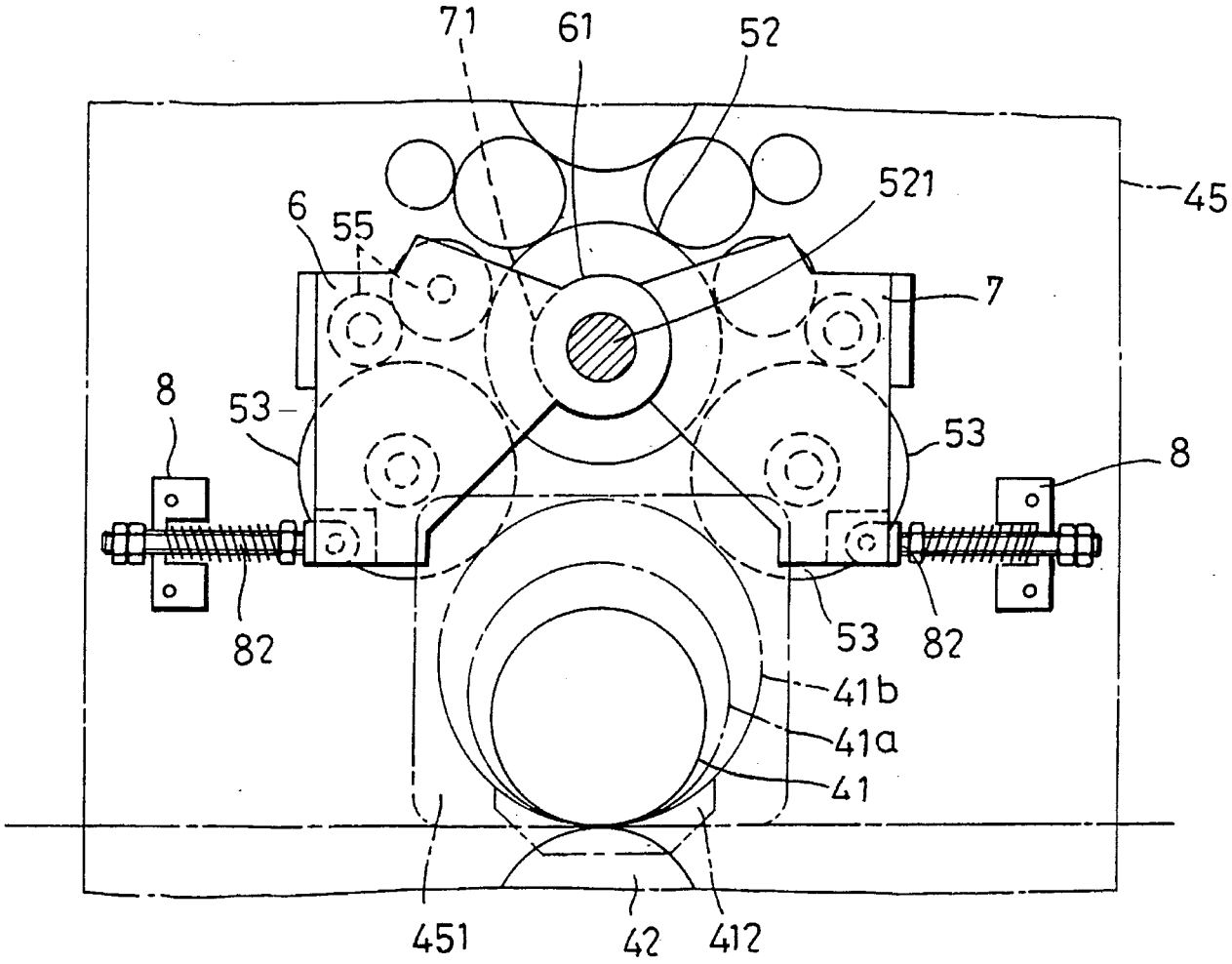
FIG. 6 illustrates how the inking apparatus of the present invention is adjusted in order to comply with the plate cylinder that is installed.

Referring to FIG. 6, since alteration of the position of the impression plate 42 between the opposed walls 45 is limited, the mounting seats 412 are replaced in order that a new plate cylinder 41*a*, 41*b* with a different diameter correspond with the impression cylinder 42. A new pair of bushing-receiving holes are formed through a new pair of mounting seats 412 with a set of bushing-receiving holes so that the replaced plate cylinder 41*a*, 41*b* can be journalled therein by the use of bushing assemblies to complement with the impression plate 42. Under such a condition, actuation of the regulators 8 can pivot the pivot blocks 6, 7 in order to supply the printing ink to the plate cylinder 41.

Note that the paper pulling mechanism 33 can be arranged by a known art to pull the continuous paper 34 continuously and when the transverse length of the printing plate is smaller than the circumference of the plate cylinder, the pulling mechanism 32 can be arranged by a known art to retract a predetermined length of paper from the traveling route in order to print the blank space thereof.

Note that the mounting seats 412 can be detached from the opposed walls 45 with ease and the forming of a pair of bushing-receiving holes to accommodate the new plate cylinder 41*a*, 41*b* can also be done with ease and at a relatively low cost. Since the inking apparatus can alter the positions of the transmission rollers to supply the printing ink to the new plate cylinder, the printing machine of the present invention can make the most use of a continuous sheet of paper. Thus, the printing machine of the present invention can print continuously a roll of continuous paper with minimum waste.

With this invention thus explained, it is apparent that numerous modifications and variations can be made without departing from the scope and spirit of this invention. It is therefore intended that this invention be limited only as indicated in the appended claims.

I claim:

1. A printing machine with at least one printing unit mounted on a base body for printing a continuous roll of paper which is pulled through said printing unit by a paper pulling mechanism for forward pulling or intermittently forward and backward pulling, said printing unit comprising;

a pair of spaced and opposed walls provided on two sides of and parallel to a paper-supplying route passing through said printing unit, said opposed walls having a pair of aligned mounting holes;

an impression cylinder journalled between said walls below said pair of mounting holes;

a pair of mounting seats which are mounted respectively and detachably in said pair of mounting holes and which are formed with a pair of aligned bushing-receiving holes therethrough corresponding with a certain size of a plate cylinder to be journalled therein so as to perform a printing action in cooperation with said impression cylinder; and an inking apparatus comprising:

a first transmission roller journalled between said opposed walls and located above said plate cylinder in a parallel manner, a second transmission roller mounted between said plate cylinder and said first transmission roller and associated operably with said first transmission roller, and an adjusting mechanism to adjust said inking mechanism to complement a position of said plate cylinder so as to enable said inking apparatus to associate with said plate cylinder in order to supply printing ink to said plate cylinder, said adjusting mechanism including at least one regulator mounted on an inner surface of said opposed walls, and a pair of pivot blocks provided between said opposed walls, each of said pivot blocks having a first end portion sleeved respectively and pivotally on two sides of an axle of said first transmission roller, and a second end portion which is located adjacent to said plate cylinder, said second transmission roller being journalled between said second end portions of said pivot blocks with said regulator being connected pivotally to said second end portion of a corresponding one of said pivot blocks, actuation of said regulator pivoting said pivot blocks relative to said axle of said first transmission roller and enabling said second transmission roller to be operable with said plate cylinder.

2. The printing machine as defined in claim 1, further comprising a stopping means for preventing said mounting seats from disengaging axially said mounting holes of said opposed walls.

* * * * *